US008118685B2

(12) United States Patent
Monge et al.

(10) Patent No.: US 8,118,685 B2
(45) Date of Patent: Feb. 21, 2012

(54) GOLF SWING PRACTICE DEVICE

(76) Inventors: Claudio Monge, Monterey Park, CA (US); Morena Monge, Monterey Park, CA (US)

( * ) Notice: Subject to any disclaimer, the term of this patent is extended or adjusted under 35 U.S.C. 154(b) by 1 day.

(21) Appl. No.: 12/504,177

(22) Filed: Jul. 16, 2009

(65) Prior Publication Data

US 2011/0014989 A1 Jan. 20, 2011

(51) Int. Cl.
*A63B 69/36* (2006.01)

(52) U.S. Cl. ..... 473/147; 473/429

(58) Field of Classification Search ..... 473/139–149, 473/423, 429

See application file for complete search history.

(56) References Cited

U.S. PATENT DOCUMENTS 1,213,679 A * 1/1917 Murphy ..... 473/148
3,622,161 A * 11/1971 Keppen ..... 473/262
3,738,660 A * 6/1973 Branz et al. ..... 473/141
3,740,054 A * 6/1973 Arkin ..... 473/139
3,870,314 A * 3/1975 Bertucci ..... 473/141
4,084,822 A * 4/1978 Keeton ..... 473/145
4,767,121 A * 8/1988 Tonner ..... 473/141
5,417,427 A * 5/1995 Doane ..... 473/145
6,106,406 A * 8/2000 Jouan ..... 473/146
6,551,194 B2 * 4/2003 Hammerquist ..... 473/145
7,462,108 B2 * 12/2008 O'Mahony ..... 473/139
7,704,154 B2 * 4/2010 Loh et al. ..... 473/221
2008/0146362 A1 * 6/2008 Cui ..... 473/139

* cited by examiner

*Primary Examiner* — Mark Graham

(57) ABSTRACT

An indoor and outdoor golf swing practicing device for a user is disclosed. The device comprises at least one hard board having a plurality of holes, at least one hinge means having a first hinge arm, a second hinge arm and a pivot arm, a plurality of wedges mounted to the hard board, at least one hanger bolt, at least one extension spring, at least one golf ball, a plurality of supporting pads attached to opposing first and second ends of an inner surface of the first hinge arm, a set of plurality of pads fixed to at least one end of the plurality of wedges proximate the hinge means and a plurality of pads fixed to the at least one hard board. A carpet is placed partially over the device to facilitate a user to stand on the hard board to practice their swing techniques.

9 Claims, 7 Drawing Sheets

GOLF SWING PRACTICE DEVICE

CROSS-REFERENCE TO RELATED APPLICATION

None

FEDERALLY SPONSORED RESEARCH

None

SEQUENCE LISTING OR PROGRAM

None

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

Golf is fantastically a popular sport all over the world and is enjoyed by people of all age groups. The beauty of the game of golf is its simplicity wrapped with its difficulty and the requirement of skills so as to hit the ball in the proper direction and desired distance. Therefore, the players have to practice the swing action frequently so as to let the swing action become precise, accurate, fixed and permanent, ensuring that the golf ball can be hit properly in each stroke. A variety of teaching and practicing aids are available, including driving ranges, plastic practice balls, and home practice devices.

Several golf practice devices have been developed in the art. U.S. Patent Application No. 20070155526 to McFarlin, discloses a portable golf practice device that is easily transported by the golfer and simulates the response of natural turf when impacted by the club head during a golf swing. The device includes a base extension, which can be unfolded and slid under a platform on which the golfer stands, for maintaining stability during use. The device includes a simulated turf surface fitted in a tray. The tray rests on a base member. When a golf ball placed on a simulated turf surface is struck by a golf club, the tray and the simulated turf surface are driven forward. Means are provided to return the tray and simulated turf surface to their original position. In its travel configuration the device folds into its compact form similar to a slim briefcase.

U.S. Pat. No. 6,786,831 to Wu discloses a golf practicing device comprised of a housing, a cover rotatably mounted on the housing, a magnetic block secured on the cover and aligning with the electromagnet, and a bar mounted on the cover for rotating the cover when the bar is hit. Thus, the energized electromagnet produces a magnetic force to magnetically attract and move the magnetic block to return the bar to the original position, so that the bar can be restored to the original position automatically, thereby facilitating the user practicing the golf skill.

In U.S. Pat. No. 6,425,830 to Chou, a golf swing practicing device is disclosed. The device includes a light comb member enclosed in a dome member, and a shaft extends through a base plate connected to the dome member and the light comb member. A mounting cap is connected to a top of the shaft extending through the dome member. A flexible rod is rotatably connected to the mounting cap. A golf ball is connected to a distal end of the flexible rod. A sensor is connected to the base plate, and the comb members of the light comb member movably engage between two lugs on the sensor. A display member is connected to the sensor so as to illustrate the information of the golf ball hit by the player.

Most of the above golf practicing devices use replica golf balls or golf ball simulating targets. These devices have an unnatural appearance. Some of the above devices need to be staked down in order for them to remain stationary. In addition, such golf practicing devices are too complex to use or too expensive to manufacture.

It is therefore, an object of the present invention to provide a golf practicing device that is simple and interesting to use and that provides a natural image of a ball lying on grass. Another object of the invention is to provide a device that allows children to practice the techniques of golf at any time and anywhere using a real golf ball. Other objects of the present invention will become better understood with reference to appended Summary, Description and Claims.

SUMMARY

The present invention is an indoor and outdoor golf swing practicing device for a user. The golf swing practicing device comprises at least one hard board having a plurality of holes, at least one hinge means having a first hinge arm, a second hinge arm and a pivot arm, a plurality of wedges mounted to the at least one hard board, at least one hanger bolt attached to the pivot arm of the at least one hinge means, at least one extension spring having a proximal end and a distal end, at least one golf ball positioned at a top end of the at least one hanger bolt, a plurality of supporting pads attached to opposing first and second ends of an inner surface of the first hinge arm, a set of plurality of pads fixed to at least one end of the plurality of wedges proximate the hinge means, and a plurality of pads that functions as an artificial golf turf pad fixed to the at least one hard board.

The plurality of holes on at least one hard board receives the at least one hinge means, the plurality of wedges, and the at least one extension spring, by a fastening means. The pivot arm of the at least one hinge means is adapted to accommodate the at least one hanger bolt. The plurality of wedges is mounted to the at least one hard board by fastening on top of the second hinge arm. A bottom end of an inner surface of the plurality of wedges can be cut to receive the at least one hinge means. The plurality of wedges is configured to receive the at least one hinge means thereby reducing the size of the at least one hinge means. A cut on at least one end of the plurality of wedges proximate the at least one hinge means is adapted to receive a set of plurality of pads. The proximal end and the distal end of the at least one extension spring is secured to the at least one of the plurality of holes of the first hinge arm and the at least one of the plurality of holes of the hard board respectively.

At least one golf ball can be positioned by adding glue to a hole in the at least one golf ball and is screwed to a top end of at least one hanger bolt. A plurality of pads fixed to at least one hard board functions as an artificial golf turf pad and reduces the noise of the impact when the at least one golf ball hits the at least one hard board. The plurality of supporting pads and the set of plurality of pads cushion the return of the first hinge arm when the first hinge arm and the at least one golf ball returns to its original position, after the at least one golf ball being hit. The set of plurality of pads fixed to the at least one end of the plurality of wedges proximate the at least one hinge means, the plurality of pads fixed to the at least one hard board and the plurality of supporting pads attached to the first end and the second end of an inner surface of a first hinge arm can be made of flip-flop sandals.

The user can practice swing by standing on at least one hard board for putting the at least one golf ball by a golf club, the weight of the user anchors the golf swing practicing device in place keeping the device stationary after the at least one golf ball being struck. The plurality of wedges helps the free back and forth movement of the at least one golf ball. The plurality of wedges further stops the at least one golf ball upon return to the original position after being struck. At least one hinge means lies between the plurality of wedges and this keeps the carpet from rubbing against a first hinge arm and also stops the return of the first hinge arm after the at least one golf ball being struck. Thus, the present invention enables a user to practice their swing techniques both indoor and outdoor and at the user's convenience.

FIGURES

Figure 1:
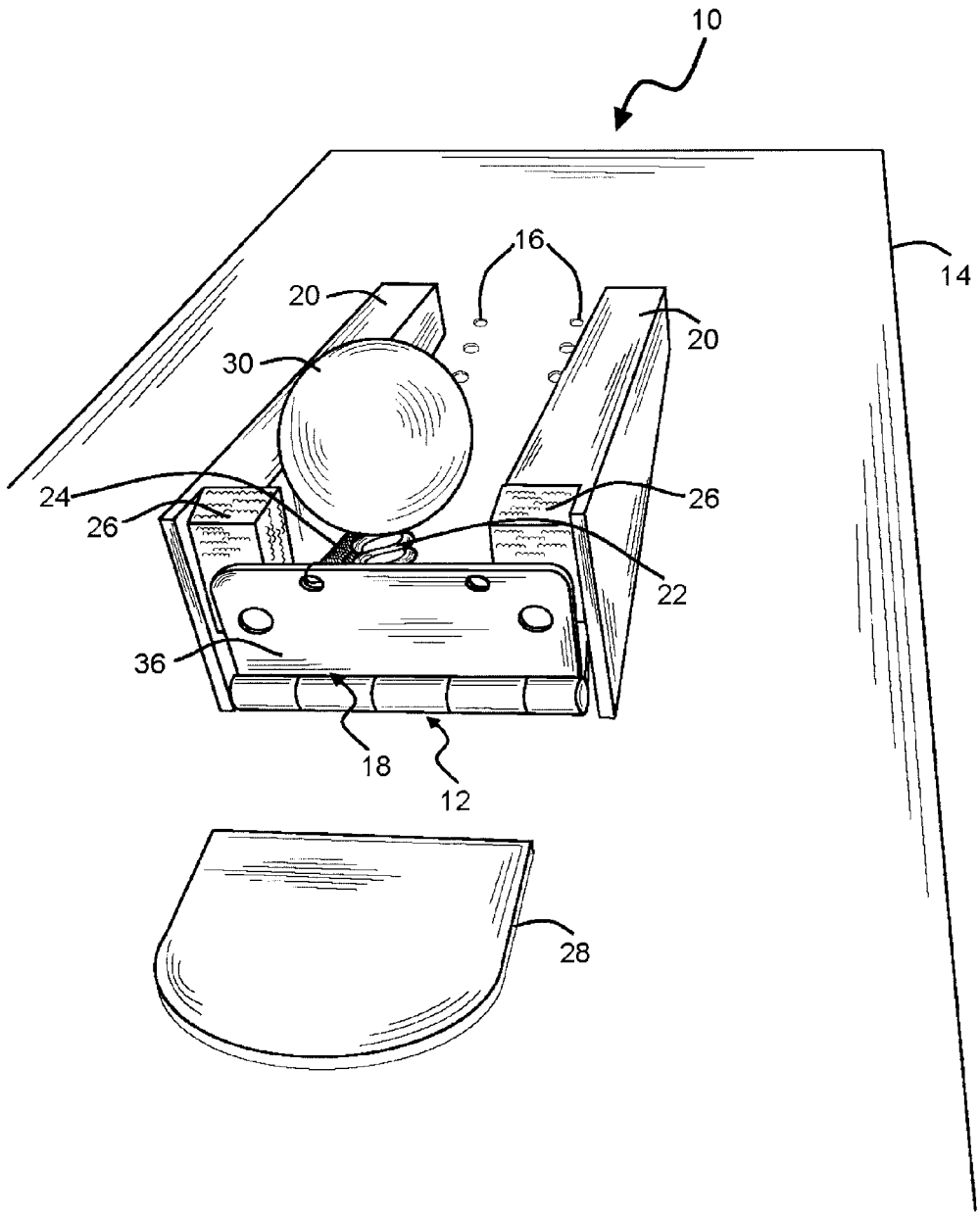
FIG. 1 is a perspective view of the invention, illustrating a golf swing practicing device with at least one golf ball wherein a first hinge arm of at least one hinge means is in a closed configuration.

The following numerals are represented in FIGS. 1 through 7:

10 . . . A golf swing practicing device
12 . . . Closed configuration of a first hinge arm of at least one hinge means of the golf swing practicing device
14 . . . At least one hard board
16 . . . A plurality of holes on the at least one hard board
18 . . . At least one hinge means
20 . . . A plurality of wedges
22 . . . At least one hanger bolt
24 . . . At least one extension spring
26 . . . A plurality of pads
28 . . . A plurality of pads
30 . . . At least one golf ball
32 . . . A top end of the hanger bolt
34 . . . An open configuration of a first hinge arm of at least one hinge means of the golf swing practicing device.
36 . . . A first hinge arm of the at least one hinge means
38 . . . A plurality of holes on the first hinge arm of the at least one hinge means
40 . . . A second hinge arm of the at least one hinge means
42 . . . A pivot arm of the at least one hinge means
44 . . . A fastening means
46 . . . A proximal end of the at least one extension spring
48 . . . A distal end of the at least one extension spring
50 . . . A plurality of supporting pads
52 . . . A first end of the first hinge arm of the at least one hinge means
54 . . . A second end of the first hinge arm of the at least one hinge means
56 . . . An inner surface of the first hinge arm of the at least one hinge means
58 . . . A user
60 . . . A carpet
62 . . . A golf club
70 . . . A method for practicing golf swing
72 . . . Providing a golf swing practicing device
74 . . . Placing a carpet over the golf swing practicing device
76 . . . User standing on at least one hard board
78 . . . Putting the at least one golf ball by a golf club
80 . . . Awaiting for the at least one golf ball to return to the original position

DESCRIPTION

Figure 2:
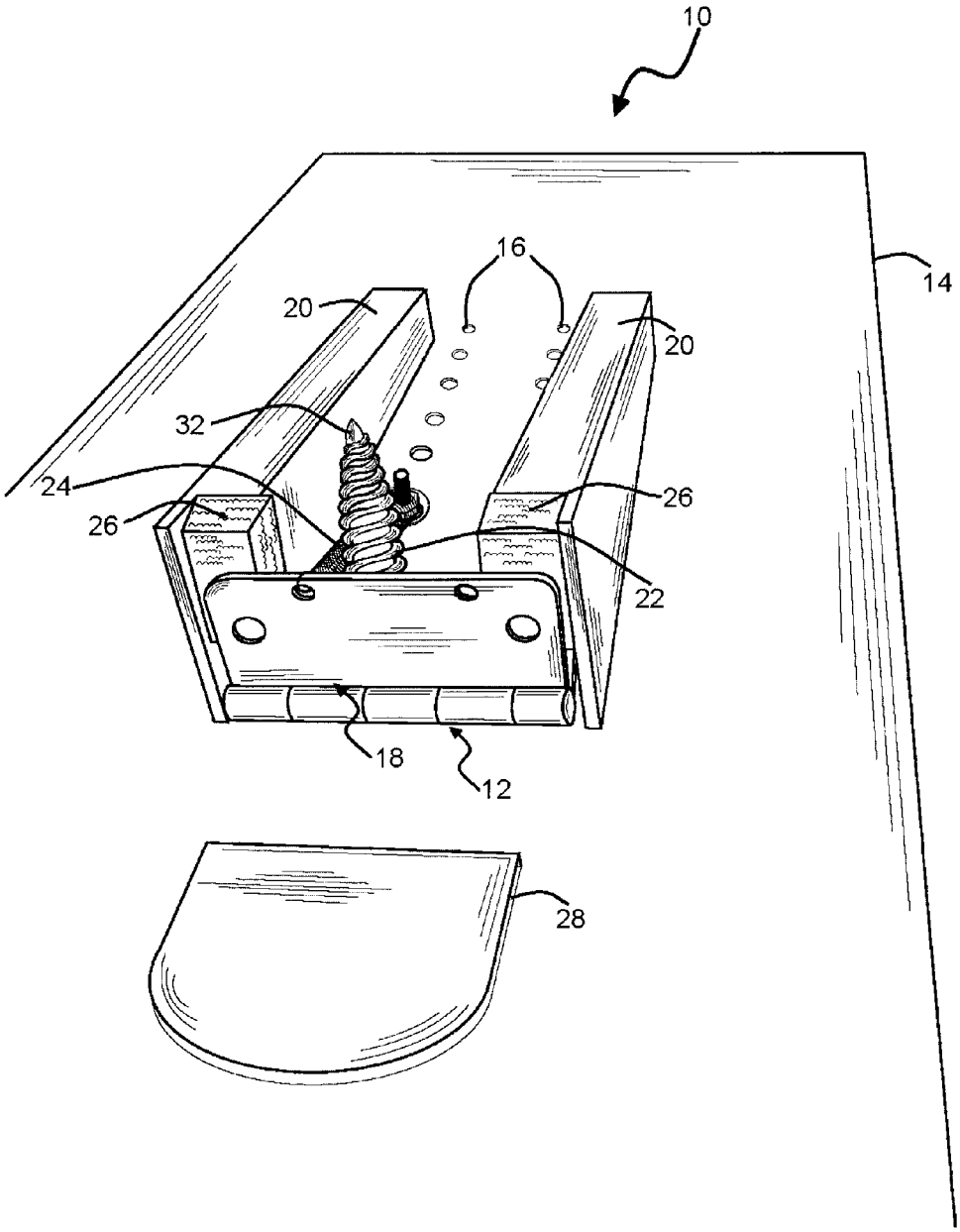
FIG. 2 is a perspective view of the invention, illustrating a golf swing practicing device without at least one golf ball wherein a first hinge arm of at least one hinge means is in a closed configuration.

Referring to the drawings, a preferred embodiment of a golf swing practicing device 10 is illustrated from FIGS. 1 to 6. FIGS. 1 and 2 show perspective views of the golf swing practicing device 10 with at least one golf ball 30 wherein a first hinge arm of at least one hinge means 36 is in a closed configuration 12. The golf swing practicing device 10 comprises of at least one hard board 14 having a plurality of holes 16, at least one hinge means 18, a plurality of wedges 20 mounted to the at least one hard board 14, at least one hanger bolt 22, at least one extension spring 24, a set of plurality of pads 26 fixed to at least one end of the plurality of wedges (not shown) proximate to at least one hinge means 18 and a plurality of pads 28 fixed to the at least one hard board 14 and at least one golf ball 30 can be positioned at a top end of the at least one hanger bolt 32.

Figure 3:
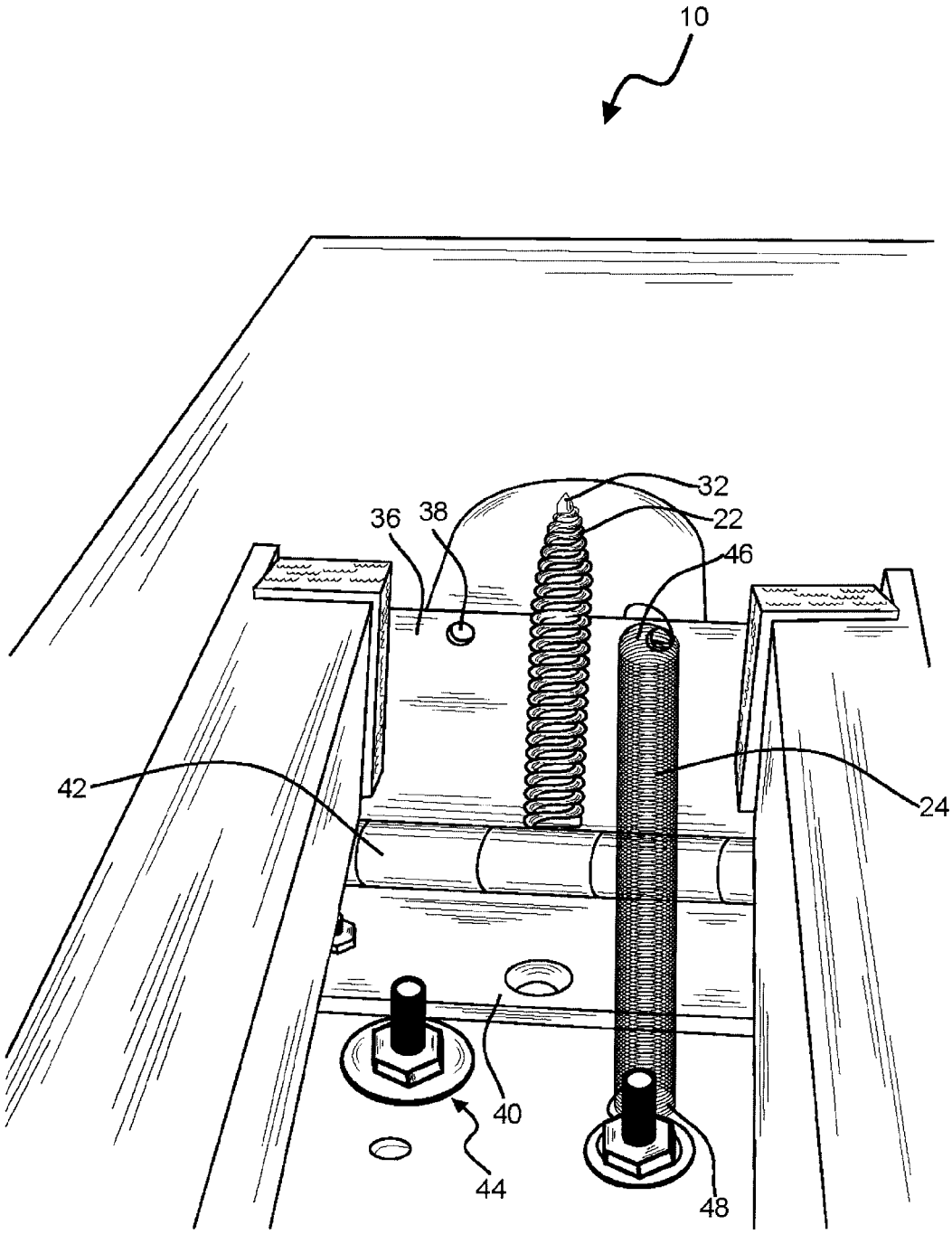
FIG. 3 is a rear perspective view of the invention, illustrating a golf swing practicing device without at least one golf ball wherein a first hinge arm of at least one hinge means is in an open configuration.

FIG. 3 illustrates a rear perspective view of a golf swing practicing device 10 without at least one golf ball 30 wherein a first hinge arm of at least one hinge means 36 is in an open configuration 34. A plurality of holes on at least one hard board 16 receives at least one hinge means 18 having a first hinge arm 36 with a plurality of holes 38, a second hinge arm 40 and a pivot arm 42, a plurality of wedges 20 and at least one extension spring 24 by a fastening means 44. The fastening means 44 can be a screw, bolt and washer. The pivot arm 42 of the at least one hinge means 18 is adapted to accommodate at least one hanger bolt 22. The plurality of wedges 20 is mounted to at least one hard board 14 by fastening on top of the second hinge arm (not shown). A bottom end of an inner surface of the plurality of wedges (not shown) can be cut to receive the at least one hinge means 18. The plurality of wedges 20 is configured to receive the at least one hinge means 18 thus reducing the size of the at least one hinge means 18. A cut (not shown) on at least one end of the plurality of wedges (not shown) proximate the at least one hinge means 18 is adapted to receive a set of plurality of pads 26. The at least one extension spring 24 includes a proximal end 46 and a distal end 48. The proximal end 46 and the distal end 48 of the at least one extension spring 24 is secured to the at least one of the plurality of holes on the first hinge arm 38 and to the at least one of the plurality of holes on the hard board 16 respectively.

Figure 4:
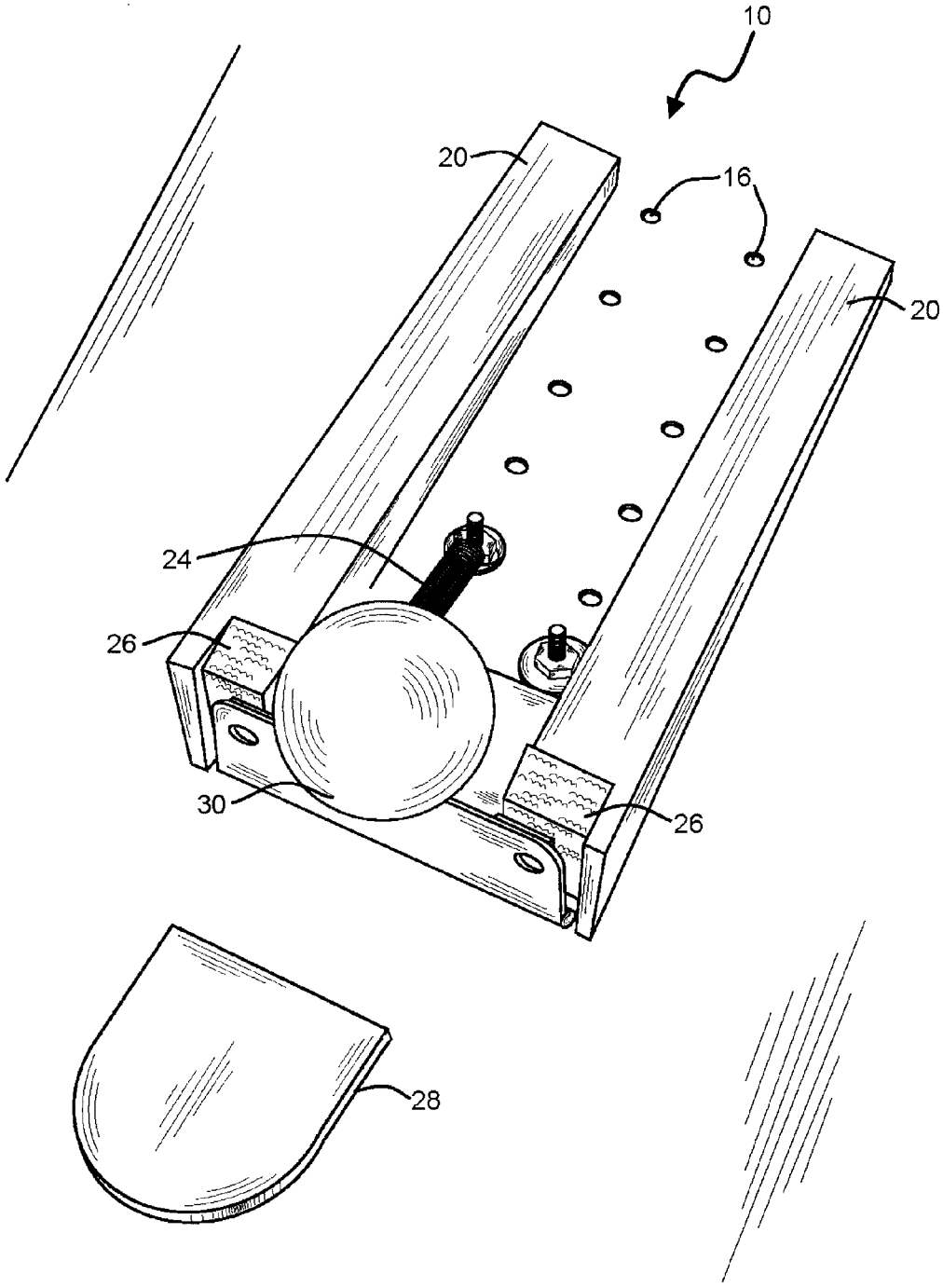
FIG. 4 is a perspective view from an angle of the invention, illustrating a golf swing practicing device with at least one golf ball wherein a first hinge arm of at least one hinge means is in a closed configuration.
Figure 5:
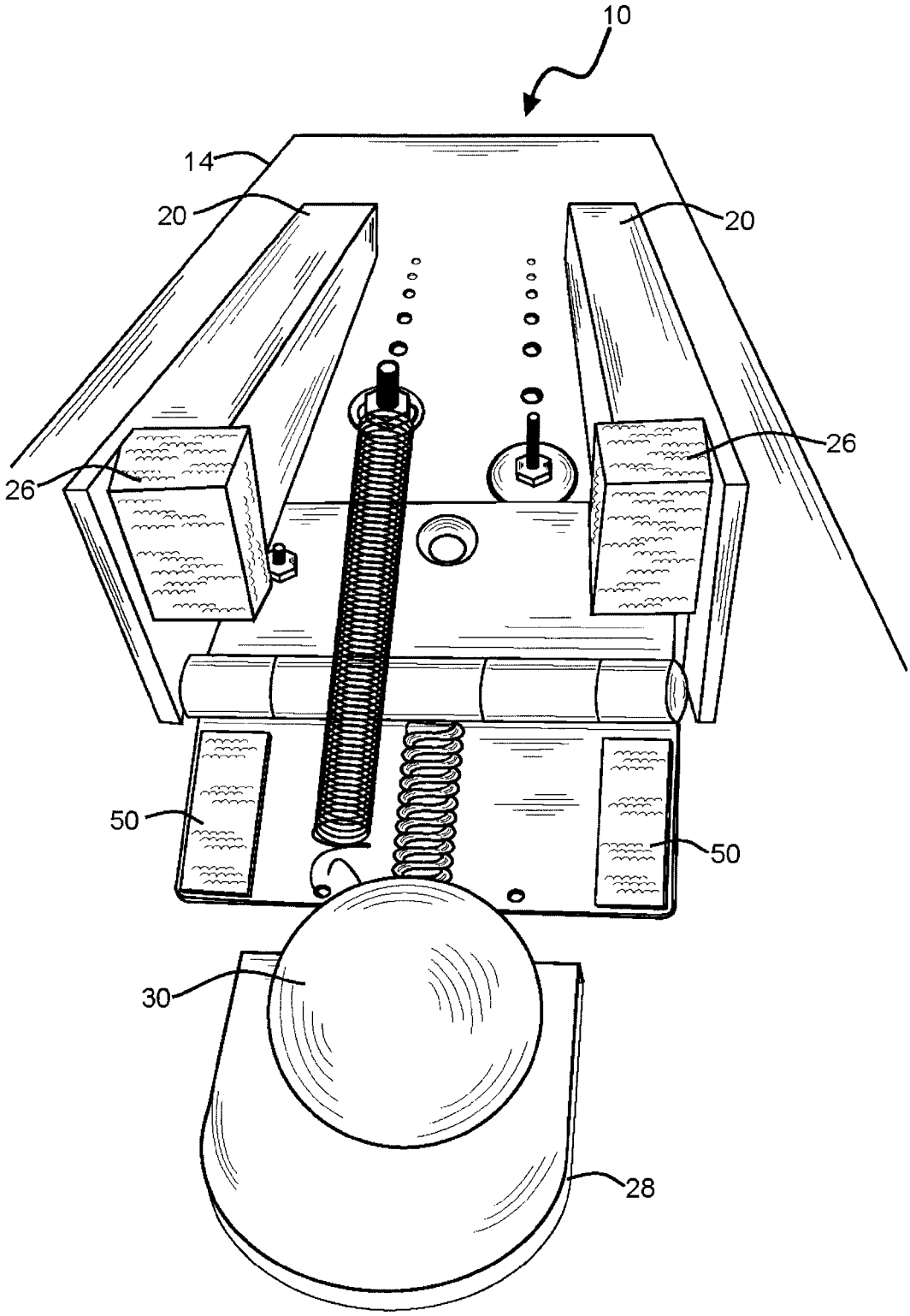
FIG. 5 is a top side view of the invention, illustrating a golf swing practicing device with at least one golf ball wherein a first hinge arm of at least one hinge means is in an open configuration.

As in FIG. 4, at least one golf ball 30 can be positioned by adding glue to a hole (not shown) in the at least one golf ball 30 and is screwed to a top end of at least one hanger bolt 32. FIG. 5 shows a front perspective view of a golf swing practicing device 10 with at least one golf ball 30. A plurality of pads 28 fixed to at least one hard board 14 functions as an artificial golf turf pad and reduces the noise of the impact when the at least one golf ball 30 hits the at least one hard board 14. The golf swing practicing device 10 is further comprised of a plurality of supporting pads 50 attached to opposing first end 52 and second end 54 of an inner surface of a first hinge arm 56 and a set of plurality of pads 26 fixed to at least one end of the plurality of wedges (not shown) proximate at least one hinge means 18. The plurality of supporting pads 50 and the set of plurality of pads 28 cushion the return of the first hinge arm 36 when the first hinge arm 36 and the at least one golf ball 30 returns to its original position, after the at least one golf ball 30 is hit. The set of plurality of pads 26 fixed to the at least one end of the plurality of wedges (not shown) proximate the at least one hinge means 18, the plurality of pads 28 fixed to the at least one hard board 14 and the plurality of supporting pads 50 attached to the first end 52 and the second end 54 of an inner surface of a first hinge arm 56 can be made of flip-flop sandals. Thickness of at least one hanger bolt 22 helps to endure the impact of a full swing of the at least one golf ball 30.

Figure 6:
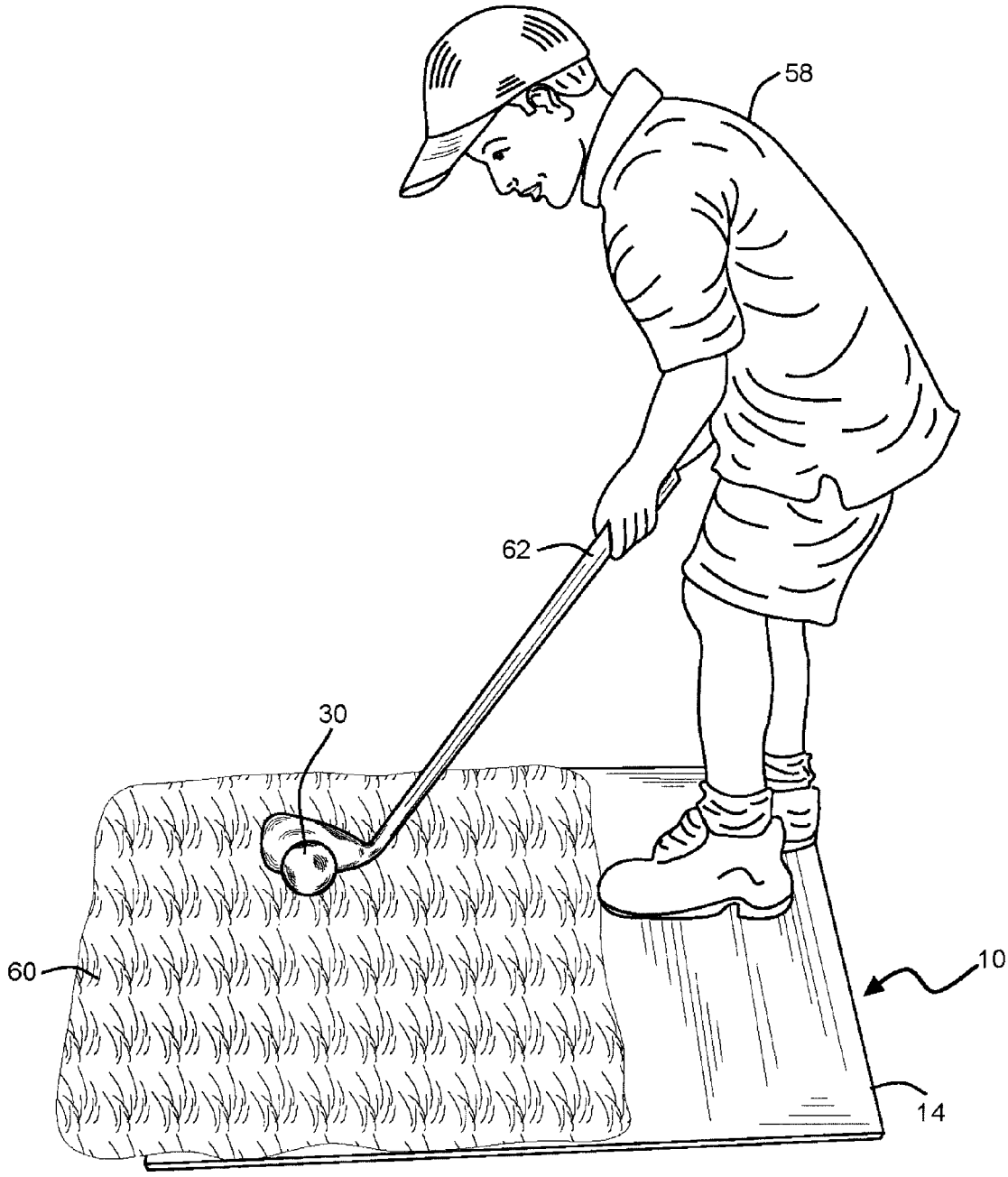
FIG. 6 is a perspective view of the invention, illustrating a user standing on a part of a golf swing practicing device and putting at least one golf ball by a golf club.

FIG. 6 illustrates a golf swing practicing device 10 being used by a user 58. A carpet 60 can be partially placed over the golf swing practicing device 10 to render an appearance of a green grass thereby giving a natural image of at least one golf ball 30 lying on grass. The carpet 60 includes a hole (not shown) adapted to receive a golf swing practicing device 10. The user 58 can practice the stance and swing by standing on at least one hard board 14. As the user 58 is standing on the at least one hard board 14 for putting the at least one golf ball 30 by a golf club 62 the weight of the user 58 anchors the golf swing practicing device 10 in place keeping the device 10 stationary after the at least one golf ball 30 being struck. The plurality of wedges helps the free back and forth movement of the at least one golf ball (not shown). The plurality of wedges (not shown) further stops the at least one golf ball 30 upon return to the original position after being struck. At least one hinge means (not shown) lies between the plurality of wedges (not shown) and this keeps the carpet 60 from rubbing against a first hinge arm (not shown) and also stops the return of the first hinge arm (not shown) after the at least one golf ball 30 is struck.

Figure 7:
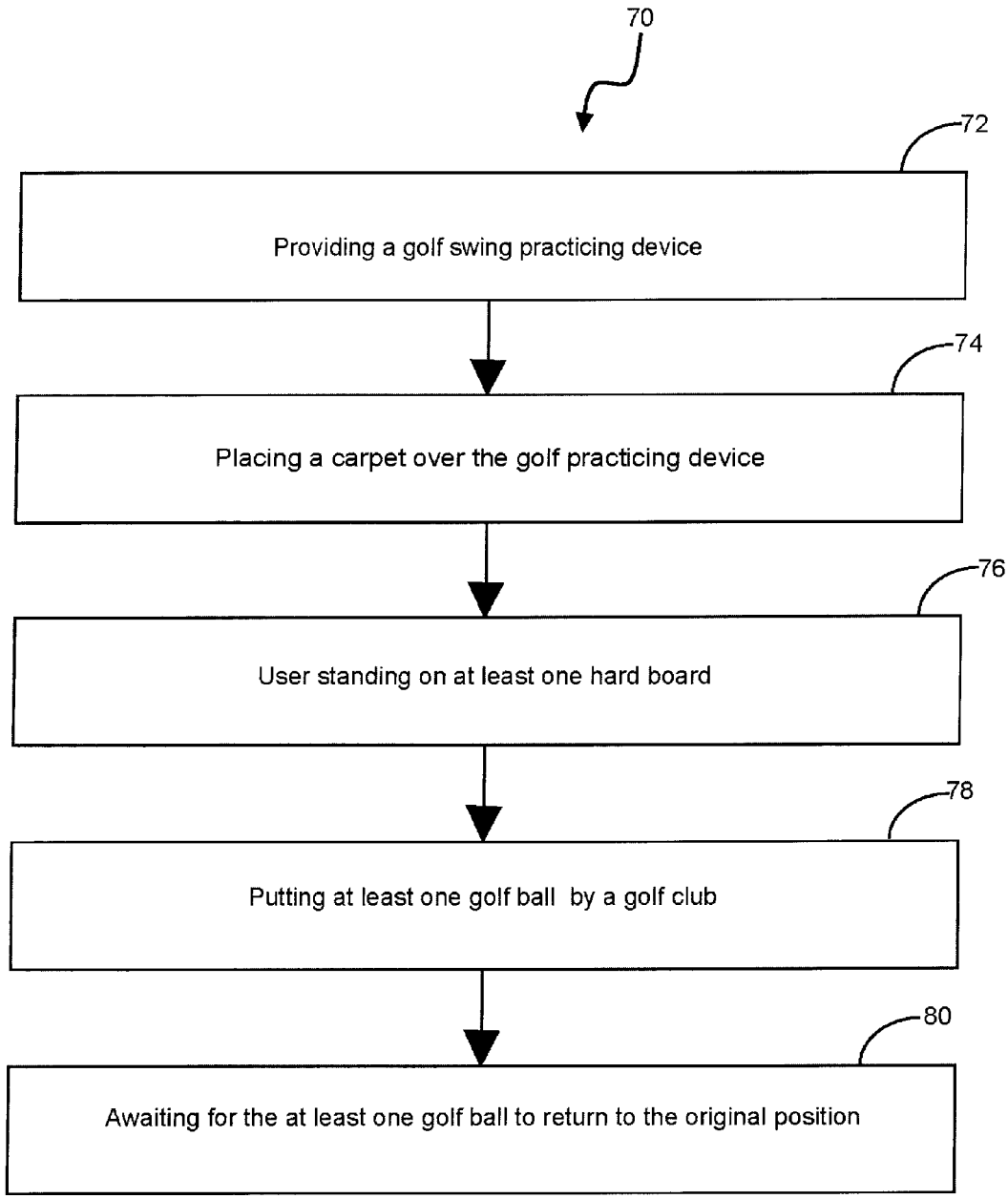
FIG. 7 is an operational flow chart of the invention, illustrating a method for practicing golf swing by a user.

FIG. 7 shows an operational flowchart of a method for practicing golf swing 70 by a user. A golf swing practicing device is provided as indicated at block 72. Further, a carpet is placed partially over the golf swing practicing device as indicated at block 74. The user stands on the at least one hard board as indicated at block 76 for putting the at least one golf ball by a golf club as indicated at block 78 and then awaiting for the at least one golf ball to return to the original position as indicated at block 80. The at least one extension spring facilitates the returning of the at least one golf ball to the original position.

All features disclosed in this specification, including any accompanying claims, abstract, and drawings, may be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means for" performing a specified function, or "step for" performing a specific function, is not to be interpreted as a "means" or "step" clause as specified in 35 U.S.C. §112, paragraph 6. In particular, the use of "step of" in the claims herein is not intended to invoke the provisions of 35 U.S.C. §112, paragraph 6.

Although preferred embodiments of the present invention have been shown and described, various modifications and substitutions may be made thereto without departing from the spirit and scope of the invention. Accordingly, it is to be understood that the present invention has been described by way of illustration and not limitation.

What is claimed is:

1. A golf swing practicing device for a user comprising:
at least one hard board having a plurality of holes adapted for surface mounting;
at least one hinge means having a first hinge arm, a second hinge arm and a pivot arm, the at least one hinge means being connected in an articulated manner to the at least one hard board;
a plurality of wedges mounted to the at least one hard board;
at least one hanger bolt attached to the pivot arm of the at least one hinge means;
at least one extension spring having a proximal end and a distal end;
at least one golf ball positioned at a top end of the at least one hanger bolt;
a plurality of supporting pads attached to opposing first and second ends of an inner surface of the first hinge arm;
a set of a plurality of pads fixed to at least one end of the plurality of wedges proximate the at least one hinge means; and
a plurality of pads that functions as an artificial golf turf pad fixed to the at least one hard board;
whereby a carpet placed over the golf swing practicing device may render an appearance of a green grass.

2. The device of claim 1, wherein the plurality of holes of the at least one hard board is adapted for receiving the at least one hinge means, the plurality of wedges and the at least one extension spring by a fastening means, including a screw, bolt and washer.

3. The device of claim 1, wherein the first hinge arm includes a plurality of holes.

4. The device of claim 2, wherein the second hinge arm is secured to the at least one hard board by the fastening means.

5. The device of claim 1, wherein the plurality of wedges is configured to receive the at least one hinge means.

6. The device of claim 1, wherein the at least one hanger bolt is attached to the pivot arm of the at least one hinge means by welding.

7. The device of claim 3, wherein the proximal end of the at least one extension spring is secured to the at least one of the plurality of holes of the first hinge arm.

8. The device of claim 2, wherein the distal end of the at least one extension spring is secured to the at least one hard board by the fastening means.

9. The device of claim 1, wherein the carpet includes a hole adapted to receive the golf swing practicing device.

* * * * *